United States Patent [19]

Takeda et al.

[11] 4,245,027

[45] Jan. 13, 1981

[54] LIGHT-SENSITIVE IMAGE RECORDING MATERIAL AND DRY PROCESS FOR RECORDING LIGHT IMAGE USING THE SAME

[75] Inventors: Keiji Takeda; Masayoshi Nagata; Kenji Matsumoto, all of Asaka, Japan

[73] Assignee: Fuji Photo Film Co., Ltd., Minami-ashigara, Japan

[21] Appl. No.: 924,014

[22] Filed: Jul. 11, 1978

[30] Foreign Application Priority Data

Jul. 11, 1977 [JP] Japan ..... 52-82690

[51] Int. Cl.[3] ..... G03C 1/52; G03C 5/24; G03C 1/58

[52] U.S. Cl. ..... 430/141; 430/176; 430/177; 430/340; 430/341; 430/344; 430/334; 430/351; 430/286; 430/907; 430/330; 430/343

[58] Field of Search ..... 96/48 R, 49, 48 HD, 96/88, 115 R, 90 R, 91 R; 430/141, 176, 177, 340, 341, 344, 334, 351, 286, 907, 330

[56] References Cited

U.S. PATENT DOCUMENTS

| | | | |
|---|---|---|---|
| 2,811,510 | 10/1957 | Leubner et al. | 96/115 R |
| 2,905,555 | 9/1959 | Fuchsman et al. | 96/115 R |
| 3,843,572 | 10/1974 | Morgan | 96/115 R |
| 4,113,497 | 9/1978 | Schlesinger | 96/115 R |

*Primary Examiner*—Won H. Louie, Jr.

*Attorney, Agent, or Firm*—Sughrue, Rothwell, Mion, Zinn and Macpeak

[57] ABSTRACT

A light-sensitive image recording material comprising, as a self-supporting film or in one or more layers on a support, at least (a) a heat sensitive coloring element comprising at least one polyvinyl pyridine and at least one polyvinylidene halide, and (b) a light sensitizing element comprising at least one of (1) a compound which, on exposure to actinic radiation, is capable of complexing the polyvinyl pyridine of element (a) or is capable of forming a quaternary salt with the polyvinyl pyridine of element (a), or (2) a compound which, on exposure to actinic radiation, is capable of releasing a precursor which is capable of complexing the polyvinyl pyridine of element (a) or is capable of forming a quaternary salt with the polyvinyl pyridine of element (a) under heating, and a dry process for recording a light image comprising (1) imagewise exposing to actinic radiation the light-sensitive image recording material described above, and (2) uniformly heating the imagewise exposed light-sensitive image recording material to a temperature of about 100° C. to about 200° C.

25 Claims, No Drawings

LIGHT-SENSITIVE IMAGE RECORDING MATERIAL AND DRY PROCESS FOR RECORDING LIGHT IMAGE USING THE SAME

BACKGROUND OF THE INVENTION

1. Field of the Invention

The present invention relates to light-sensitive image recording materials and particularly, to those which utilize an intermolecular reaction which occurs between two kinds of polymers. More specifically, it relates to dry processes for recording light images using such recording materials.

2. Description of the Prior Art

In the past silver halide light-sensitive materials, diazo light-sensitive materials and the like have been mainly employed as light-sensitive image recording (photographic) materials. However, these materials require exclusively a wet development processing. Numerous attempts to record images using dry processing, for instance, by heat development, have been made in recent years for the purpose of elimination of the disadvantages inherent in wet development processes. For instance, materials such as heat developable light-sensitive materials [one example of which is commercially available under the tradename of "Dry Silver" (produced by 3M Co.)] utilizing a silver salt of a fatty acid, heat developable diazo light-sensitive materials, light-sensitive materials utilizing organic tellurium compounds (as disclosed in, for example, British Pat. No. 1,405,628) and so on have been developed. These light-sensitive materials, unfortunately, have their own defects. Namely, materials using silver salts of fatty acids are expensive because silver is employed therein and a large amount of skill is required to prepare such a light-sensitive material. Toxicity is a problem in light-sensitive materials containing organic tellurium compounds since they are toxic, and heat developable diazo light-sensitive materials tend to fog upon storage and are unstable.

On the other hand, it is known that halogen-containing high polymers such as polyvinyl chloride, polyvinylidene chloride and the like undergo a dehydrohalogenation due to the interaction of light or heat to produce conjugated polyenes and thereby, a color is formed. A number of studies have been made on this reaction mainly from the standpoint of stabilization of halogen-containing high polymers, and recent results of this research are summarized in G. Ayrey, B. C. Head and R. C. Poller, "Macromolecular Reviews", *J. Polymer Sci: Macromolecular Reviews,* volume 8, page 1 (1974). Light-sensitive image recording materials taking advantage of the lability of halogen-containing high polymers and particularly, the property that they can be changed to polyenes and thereby, become colored, were proposed in Japanese Patent Publications Nos. 10647/75 and 35451/76; U.S. Pat. Nos. 3,615,456; 2,772,159; 3,046,136; 3,155,513; 2,712,996 and 2,754,210; and S. B. Elliot, *Photographic Eng.,* volume 4, page 133 (1953). In each of these light-sensitive image recording materials, polyene images are produced by employing materials which are capable of accelerating the dehydrohalogenation reaction which halogen-containing high polymers undergo due to the interaction of light (e.g., metallic oxides) with the halogen-containing high polymers, exposing the recording materials to light and optionally, by heating. Since light-sensitive image recording materials of this kind primarily utilize, however, the lability of halogen-containing high polymers, achieving a stabilization of the light-sensitive materials and an increase in sensitivity to light simultaneously has been regarded as technically difficult if not technically opposed.

Now, in a prior application we discovered that heat-sensitive coloring compositions comprising solid mixtures of basic polymers, such as polyvinyl pyridines, and halogen-containing high polymers, such as polyvinylidene halides, were colored brownish-black by heating, as disclosed in Japanese Patent Application No. 16369/77 (corresponding to U.S. patent application Ser. No. 878,351, filed Feb. 16, 1978).

It was found therein that coloration was not observed in practice when only polyvinylidene halides were heated (e.g., at a temperature of 100° to 200° C.). Accordingly, it was thought that the thermal coloration of the above-described solid mixtures in part involved an intermolecular reaction between different polymers (presumably corresponding to an acceleration of the dehydrohalogenation reaction of polyvinylidene halides by capture of hydrogen halides using the polyvinyl pyridines).

Therefore, the above-described heat sensitive coloring compositions are quite stable at temperatures in the vicinity of room temperature (25° C.), and can be stored for a long time without fogging occurring. On the other hand, coloration can proceed with a practically sufficient speed only after affirmative heating (up to, for instance, a temperature higher than the glass transition points of the polyvinyl pyridines used).

Moreover, the thus produced colored materials are considered to be composed of "polyenes", as such are defined in Japanese Patent Application No. 16369/77, and the colored materials are quite stable to external stimuli such as light, heat, moisture and so on.

SUMMARY OF THE INVENTION

Consequently, further research on rendering the above-described heat sensitive coloring compositions light-sensitive without losing their desirable characteristics have been undertaken and the present invention has been accomplished.

Therefore, one object of the present invention is to provide light-sensitive image recording materials which are highly sensitive to light, which have excellent storage stability, for which no questions regarding toxicity are raised, which can be used to produce images having high stability and which can be prepared in a simple manner from inexpensive materials.

Another object of the present invention is to provide a novel dry process for recording images using the above-described light-sensitive image recording materials.

The above-described objects are attained in one embodiment of this invention providing a light-sensitive image recording material comprising, as a self-supporting film or in one or more layers on a support, at least (a) a heat sensitive coloring element comprising at least one polyvinyl pyridine and at least one polyvinylidene halide, and (b) a light sensitizing element comprising at least one of (1) a compound which, on exposure to actinic radiation, is capable of complexing the polyvinyl pyridine of element (a) or is capable of forming a quaternary salt with the polyvinyl pyridine of element (a), or (2) a compound which, on exposure to actinic radiation, is capable of releasing a precursor which is capable of complexing the polyvinyl pyridine of element (a) or is capable of forming a quaternary salt with the polyvinyl pyridine of element (a) under heating.

The above-described objects are attained in another embodiment of this invention providing a dry process for producing images comprising imagewise exposing the light-sensitive image recording material described above to actinic radiation, wherein, in the exposed areas, a complexing of the polyvinyl pyridine of element (a) or a production of the quaternary salt of the polyvinyl pyridine of element (a), or a releasing of a precursor capable of complexing the polyvinyl pyridine of element (a), or of forming a corresponding quaternary salt with the polyvinyl pyridine of element (a) under heating occurs, and heating the recording material to a temperature of about 100° C. to about 200° C. to result in an acceleration of a dehydrohalogenation reaction of the polyvinylidene halide of element (a) which occurs due to the action of the polyvinyl pyridine of element (a) present only in the unexposed areas, which has not been complexed or quaternized, with the production of a colored image of the resulting polyenes in the unexposed areas occurring.

DETAILED DESCRIPTION OF THE INVENTION

As described above, a heat sensitive coloring element comprising a mixture of a polyvinyl pyridine and a polyvinylidene halide can function as an element capable of being colored with a practically sufficient speed only when the heat sensitive coloring element is heated to a temperature higher than a definite temperature. While not desiring to be bound, this coloration is considered to proceed by the following mechanism. The polyvinyl pyridine captures the hydrogen halide resulting from the dehydrohalogenation of the polyvinylidene halide and is changed to the corresponding quaternary salt thereof. As a result, the dehydrohalogenation reaction of the polyvinylidene halide can be accelerated.

In contrast, the light sensitizing element of this invention functions on the basis of a deactivation, in an imagewise manner, of the ability of the polyvinyl pyridine to act as an accelerator for the dehydrohalogenation of the polyvinylidene halide. Namely, the light sensitizing element contains a component which is capable of complexing the above-described polyvinyl pyridine or changing the polyvinyl pyridine to the corresponding quaternary salt thereof in an imagewise manner directly upon exposure to an imagewise pattern of actinic radiation, or indirectly by heating subsequent to the exposure to the imagewise pattern of actinic radiation. This capability inhibits the ability of the polyvinyl pyridine to capture hydrogen halide (which corresponds to an ability to inhibit the acceleration of the dehydrohalogenation of the polyvinylidene halide by the polyvinyl pyridine under heating to convert the polyvinylidene halide into a polyene).

The subsequent heat development after exposure is carried out at a temperature higher than a definite temperature (e.g., about 100° C. to about 200° C.) to produce positive-positive type colored image of polyenes because the above-described coloration will proceed only in the unexposed areas.

Suitable polyvinyl pyridines which are preferably employed in the present invention include polymers containing, as a repeating unit, at least one repeating unit derived from an addition polymerizable monomer selected from the group consisting of the vinyl pyridine compounds represented by the general formulae (I) and (II) described below. More specifically suitable polyvinyl pyridines include homopolymers of an addition polymerizable monomer selected from the group consisting of the vinyl pyridine compounds represented by the general formulae (I) and (II) described below; copolymers of at least two different addition polymerizable monomers selected from the group consisting of the vinyl pyridine compounds represented by the general formulae (I) and (II) described below; and copolymers of at least one addition polymerizable monomer selected from the group consisting of the vinyl pyridine compounds represented by the general formulae (I) and (II) described below and at least one other addition polymerizable monomer copolymerizable therewith.

Suitable addition polymerizable vinyl pyridine monomers which are used are represented by the general formula (I) or (II)

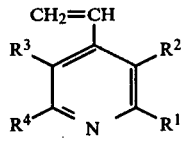

(I)

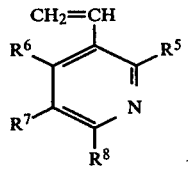

(II)

wherein $R^1$, $R^2$, $R^3$, $R^4$, $R^5$, $R^6$, $R^7$ and $R^8$, which may be the same or different, each represents a hydrogen atom or a straight or a branched chain alkyl group containing 1 to 7 carbon atoms (e.g., a methyl group, an ethyl group, an n-propyl group, an isopropyl group, an n-butyl group, a t-butyl group, an n-heptyl group, etc.). However, substituents exerting no or only a small degree of steric hindrance upon the nitrogen atom are preferred as $R^1$, $R^4$, $R^5$ and $R^8$ and specific examples of such substituents include a hydrogen atom, a methyl group, an ethyl group, an n-propyl group, an isopropyl group and an n-butyl group. Preferred specific examples of vinyl pyridine monomers include 4-vinylpyridine, 3-vinylpyridine, 2-methyl-4-vinylpyridine, 2-ethyl-5-vinylpyridine, 3-methyl-5-vinylpyridine, 3-n-butyl-5-vinylpyridine, 2-ethyl-4-vinylpyridine, 3-methyl-4-vinylpyridine, 3-isopropyl-4-vinylpyridine, 2-methyl-5-vinylpyridine, and the like.

In the case of copolymers, the copolymer may be a copolymer of two or more of the above-described vinyl pyridine monomers or the copolymer may be a copolymer of one or more of the above-described vinyl pyridine monomers and one or more other addition polymerizable monomers capable of copolymerizing with the above-described vinyl pyridine monomers a broad range of different copolymerizable monomers can be used. There is no restriction on the copolymerization ratio between vinyl pyridine in copolymers containing only vinyl pyridine monomers but in copolymers with other copolymerizable addition polymerizable monomers the mole fraction of the vinyl pyridine monomer units to the total monomer units in the resulting copolymer is preferably more than about 0.3.

Examples of suitable addition polymerizable monomers capable of copolymerizing with the vinyl pyridine monomers of the general formulae (I) and (II) above which can be used include mono-olefin compounds such as ethylene, propylene, butene, cyclopentylethylene, cyclohexylethylene, etc.; diene compounds such as butadiene, isoprene, chloroprene, methoxybutadiene, cyclopentadiene, 1,3-cyclohexadiene, etc.; vinyl halide compounds such as vinyl chloride, vinyl bromide, etc.; vinyl ether compounds such as vinyl methyl ether, vinyl ethyl ether, vinyl n-propyl ether, vinyl isopropyl ether, vinyl n-butyl ether, vinyl isobutyl ether, vinyl tert-butyl ether, vinyl neopentyl ether, vinyl 2-methoxyethyl ether, vinyl 2-chloroethyl ether, vinyl 2,2,2-trifluoroethyl ether, vinyl benzyl ether, etc.; styrene compounds such as styrene, α-methylstyrene, 4-chlorostyrene, dichlorostyrene, 2,5-dimethoxystyrene, 4-methylstyrene, 4-ethylstyrene, etc.; aromatic vinyl compounds other than styrene compounds, such as 4-vinylbiphenyl, 9-vinylanthracene, acenaphthylene, indene, etc.; N-heterovinyl compounds other than the compounds represented by formulae (I) and (II) such as N-vinylcarbazole, N-vinylpyrrolidone, N-vinylpyridine, etc.; acrylic acid compounds such as acrylic acid, methacrylic acid, etc.; acrylic acid ester compounds such as methyl acrylate, ethyl acrylate, butyl acrylate, etc.; methacrylic acid esters such as methyl methacrylate, ethyl methacrylate, n-propyl methacrylate, n-butyl methacrylate, isobutyl methacrylate, n-hexyl methacrylate, 2-ethylbutyl methacrylate, n-lauryl methacrylate, 4-(tert-butyl)phenyl methacrylate, bornyl methacrylate, etc.; acrylonitrile compounds such as acrylonitrile, methacrylonitrile, etc.; acrylamide compounds such as acrylamide, N,N-dimethylacrylamide, N-(1,1-dimethyl-3-oxobutyl)acrylamide, etc., and the methacrylamides corresponding thereto; vinyl methyl ketone; methyl isopropenyl ketone; 1-nitropropylene; vinylsulfonic acid; maleic anhydride; allyl alcohol; vinyl ester compounds such as vinyl acetate, vinyl chloroacetate, vinyl n-butyrate, vinyl isobutyrate, vinyl pivalate, vinyl caprate, vinyl laurate, vinyl benzoate, vinyl sulfate, etc.; and so on. In addition, suitable polyvinyl pyridines include such copolymers obtained by hydrolysis of or treatment with an aldehyde of at least part of the vinyl ester units forming the copolymer together with the above-described vinyl pyridine monomers (more specifically copolymers containing the above-described vinyl pyridine basic monomer units in the main chain of a polyvinyl alcohol or a polyvinyl alkylene acetal such as polyvinyl formal, polyvinyl acetal, polyvinyl butyral, polyvinyl isobutyral or the like).

Of the above-described polyvinyl pyridines, the most suitable polyvinyl pyridines for the present invention are poly-4-vinylpyridine and poly-3-vinylpyridine.

A preferred average molecular weight for the polyvinyl pyridine ranges, in general, from about 10,000 to about 1,000,000.

Suitable polyvinylidene halides which can be used in the present invention include homopolymers of vinylidene halides, copolymers of two or more different vinylidene halides and copolymers of one or more vinylidene halides and at least one other addition polymerizable monomer copolymerizable with a vinylidene halide. Preferred vinylidene halide monomers are vinylidene chloride and vinylidene bromide.

In the copolymers of vinylidene halides and other addition polymerizable monomers, it is preferred for the mole fraction of the vinylidene halide monomer units to the total monomer units in such a copolymer to be more than about 0.3.

Specific examples of suitable addition polymerizable monomers copolymerizable with the above-described vinylidene halide monomers include vinyl halide compounds such as vinyl chloride, vinyl bromide, vinyl fluoride, etc.; halopropene compounds such as 2-chloropropene, 1-chloropropene, 2-fluoropropene, etc.; mono-olefin compounds such as ethylene, propylene, butene, pentene, cyclopentylethylene, cyclohexylethylene, etc.; diene compounds such as butadiene, isoprene, chloroprene, methoxybutadiene, 1,3-cyclohexadiene, cyclopentadiene, etc.; vinyl ether compounds such as vinyl methyl ether, vinyl ethyl ether, vinyl n-propyl ether, vinyl isopropyl ether, vinyl n-butyl ether, vinyl isobutyl ether, vinyl tert-butyl ether, vinyl neopentyl ether, vinyl 2-methoxyethyl ether, vinyl 2-chloroethyl ether, vinyl 2,2,2-trifluoroethyl ether, vinyl benzyl ether, etc.; styrene compounds such as styrene, α-methylstyrene, 4-chlorostyrene, dichlorostyrene, 2,5-dimethoxystyrene, 4-methylstyrene, 4-ethylstyrene, p-vinylbenzyl propyl ether, etc.; aromatic vinyl compounds, other than styrene series compounds, such as 4-vinylbiphenyl, 9-vinylanthracene, acenaphthylene, indene, etc.; N-heterovinyl compounds such as N-vinylcarbazole, N-vinylpyrrolidone, N-vinylpyridine, etc.; acrylic acid compounds such as acrylic acid, methacrylic acid, etc.; acrylic acid ester compounds such as methyl acrylate, ethyl acrylate, butyl acrylate, etc.; methacrylic acid ester compounds such as methyl methacrylate, ethyl methacrylate, n-propyl methacrylate, n-butyl methacrylate, isobutyl methacrylate, n-hexyl methacrylate, 2-ethylbutyl methacrylate, n-lauryl methacrylate, 4-(tert-butyl)phenyl methacrylate, bornyl methacrylate, etc.; acrylonitrile compounds such as acrylonitrile, methacrylonitrile, etc.; acrylamide compounds such as acrylamide, N,N-dimethylacrylamide, N-(1,1-dimethyl-3-oxobutyl)acrylamide, etc., and the methacrylamides corresponding thereto; vinyl methyl ketone; methyl isopropenyl ketone; 1-nitropropylene; vinylsulfonic acid; maleic anhydride; allyl alcohol; vinyl ester compounds such as vinyl acetate, vinyl chloroacetate, vinyl n-butyrate, vinyl isobutyrate, vinyl pivalate, vinyl caprate, vinyl laurate, vinyl benzoate, vinyl sulfate, etc.; and so on. In addition, the polyvinylidene halides may be copolymers which are obtained by hydrolyzing of or treatment with aldehydes of at least part of the above-described vinyl ester units of a copolymer of such a vinyl ester monomer with the above-described vinylidene halide monomers (more specifically copolymers containing the above-described vinylidene halide monomer units in the main chain of a polyvinyl alcohol or a polyvinyl alkylene acetal such as polyvinyl formal, polyvinyl acetal, polyvinyl butyral, polyvinyl isobutyral or the like).

The most effective polyvinylidene halides in the present invention are vinylidene chloride-acrylonitrile copolymers in which the mole fraction of vinylidene chloride units ranges from about 0.35 to about 0.95. This is because the most marked coloration occurs on heating a mixture of these copolymers and polyvinyl pyridines. Where these copolymers have a vinylidene chloride mole fraction smaller than about 0.35, the speed and the extent of coloration occurring on heating mixtures of these copolymers and polyvinyl pyridines become low. On the other hand, with vinylidene chloride mole fractions larger than about 0.95, it becomes difficult to prepare image recording materials of the present invention because of the poor solubility of such copolymers in any solvents.

A preferred average molecular weight of the polyvinylidene halides range, in general, from about 10,000 to about 1,000,000.

Further, where the polyvinyl pyridines and/or the polyvinylidene halides are copolymers, any type of copolymer, e.g., a binary copolymer, a ternary copolymer, a block-copolymer or a graft-copolymer, may be employed in the present invention.

Methods for producing the various kinds of polymers as described above are well-known (e.g., as disclosed in, for instance, T. Tamikado, *J. Polymer Sci.*, volume 43, page 489 (1960) and more specifically, in Japanese Patent Application 16369/77) and, polymers which can be employed in the present invention can be easily synthesized based on these descriptions.

Examples of the synthesis of these polymers are described below. Unless otherwise indicated, all parts, percents, ratios and the like are by weight.

SYNTHESIS EXAMPLE 1

Synthesis of Poly(4-vinylpyridine):

In a 300 ml three necked flask were charged 40 g of purified 4-vinylpyridine, 150 ml of N,N-dimethylformamide purified under a nitrogen atmosphere and 0.1 g of azobisisobutyronitrile. The mixture was polymerized for 8 hrs at 70° C. under a nitrogen atmosphere. The reaction liquid was gradually added to a large amount of toluene so that polymer was precipitated. After filtering and drying, the polymer was dissolved again in N,N-dimethylformamide. The solution was dropwise added to a large amount of toluene, followed by filtering and drying. The so obtained powder was white and the yield was 47%. The average molecular weight was 60,000.

SYNTHESIS EXAMPLE 2

Synthesis of Poly(4-vinylpyridine-styrene) Copolymer:

In a 200 ml three necked flask were charged 21 g of 4-vinylpyridine, 21 g of styrene and 0.1 g of azobisisobutyronitrile and 90 ml of benzene. The mixture was polymerized at 80° C. for 6 hrs under a nitrogen atmosphere. The reaction liquid was poured into a large amount of n-hexane to thereby obtain white precipitates. After filtering and drying, a white powder was obtained. The molar fraction of vinylpyridine in the polymer was 0.57 and the yield was 20%.

SYNTHESIS EXAMPLE 3

Synthesis of Poly(vinylidene chloride-styrene) Copolymer:

In a 300 ml three necked flask were charged 150 ml of distilled water which was sufficiently purged with nitrogen gas, and 0.75 g of sodium lauryl sulfonate. Under a nitrogen atmosphere, 1/10 of a mixture of vinylidene chloride (30 g), styrene (20 g) and benzene (trace) was poured thereinto. The mixture was kept on a warm water bath maintained at 30° C. and stirring of the mixture was continued for 20 mins. Thereafter, 10 ml of an aqueous solution containing 0.75 g of potassium persulfate and 10 ml of an aqueous solution containing 0.75 g of sodium bisulfite were added to the mixture, in several portions. The monomer mixture was also added dropwise. The reaction was completed in three hours. The reaction liquid was salted out with an aqueous sodium chloride solution and then the precipitates were dissolved in methyl ethyl ketone. The solution was poured into methyl alcohol. After filtering and drying, a white powder was obtained. The molar fraction of vinylidene chloride in the polymer was 0.44 and the yield was 10%.

SYNTHESIS EXAMPLE 4

Synthesis of Poly(vinylidene chloride-acrylonitrile) Copolymer:

Into a 300 ml three necked flask were charged 150 ml of distilled water which was sufficiently purged with nitrogen gas, and 0.75 g of sodium lauryl sulfonate. Under a nitrogen atmosphere, a 1/10 amount of a mixture of vinylidene chloride (20 g), acrylonitrile (10 g) and benzene (trace) was poured thereinto. The mixture was kept in a warm water bath maintained at 30° C. After stirring the mixture for 20 mins, 10 ml of an aqueous solution containing 0.75 g of potassium persulfate and 10 ml of an aqueous solution containing 0.75 g of sodium bisulfite were portionwise added to the mixture. The monomer mixture solution was also dropwise added thereto. The reaction was completed in 3 hrs. After the reaction liquid was salted out with an aqueous sodium chloride solution, the precipitates were dissolved in N,N-dimethylformamide. The solution was poured into methyl alcohol. After filtering and drying, a white powder was obtained. The molar fraction of vinylidene chloride in the polymer was 0.78 and the yield was 15%.

Other homopolymers and copolymers can be easily synthesized following the methods described above.

A preferred weight ratio of the polyvinyl pyridine to the polyvinylidene halide ranges from about 8:1 to about 1:5, preferably from 4:1 to 1:2. In this weight ratio range, the rate or the extent of coloration due to heating is sufficiently large. However, coloration takes place to a probably appreciable extent even if the weight ratio of the polyvinyl pyridine and the polyvinylidene halide is out of the above-described range because the rate or the extent of coloration varies slowly as the weight ratio is changed. Therefore, mixtures with weight ratios outside of the above-described range can be employed in the present invention. Accordingly, the above-described weight ratio range is given only as a guideline and should not be construed as being limiting.

The light sensitizing element (b) employed in the present invention may be compounds capable of converting the polyvinyl pyridine to the complex salt thereof or to the quaternary salt thereof upon exposure to actinic radiation, or may be compounds capable of releasing precursors capable of converting the polyvinyl pyridine to the complex salt thereof or to the quaternary salt thereof under heating when exposed to actinic radiation or in other words, compounds which are capable of releasing precursors upon exposure to actinic radiation, which precursors are capable of releasing materials which are capable of converting the polyvinyl pyridine to the complex salt thereof or to the quaternary salt thereof under heating.

In the present invention, the phrase "complexing of polyvinyl pyridine" is intended to include preferably the formation of coordinate bonds between unshared pairs of electrons of the tertiary nitrogen atoms of the pyridyl groups present in the polyvinyl pyridine and metal ions (i.e., $M^{n+}$), which can be represented by the formula

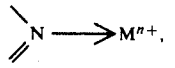

and the producing of a kind of bonding condition between the pyridyl groups and iodine molecules or organic electron-accepting molecules through an interaction caused by a partial transfer of electrons from the pyridyl groups to the iodine molecules or the electron-accepting organic molecules; that is to say, through a charge transfer interaction. On the other hand, the phrase "converting of polyvinyl pyridine to a quaternary salt" means that the polyvinyl pyridine is converted to an onium compound by addition of, preferably, protons or carbonium ions, most preferably, protons, to the unshared pairs of electrons of the tertiary nitrogen atoms

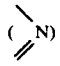

of the pyridyl groups.

Accordingly, the compounds preferably employed as the light sensitizing element component (b) in the present invention are those compounds which can release precursors through exposure to actinic radiation, in which the precursors can release metal ions, iodine molecules or electron accepting organic molecules, each of which can complex the pyridyl groups present in the polyvinyl pyridine, or protons or carbonium ions (preferably, protons) capable of converting the pyridyl groups to a quaternary salt form under heating; or those compounds which can release the above-described metal ions, iodine molecules, electron-accepting organic molecules or protons directly upon exposure to actinic radiation.

Specific examples of preferred compounds which can be employed in this invention as light sensitizing element component (b) as described above include:

(1) Iodoform

Iodoform decomposes upon exposure to actinic radiation to release hydrogen iodide or iodine molecules. The resulting hydrogen iodide molecules convert the pyridyl groups of the polyvinyl pyridine to quaternary salts, or the resulting iodine molecules complex the pyridyl groups of the polyvinyl pyridine and consequently, the heat sensitive coloring reaction of the mixture of the polyvinyl pyridine and the polyvinylidene halide is inhibited. A suitable proportion of iodoform ranges preferably from about 1.5 to about 3 parts by weight and particularly, preferably from 1.7 to 2.5 parts by weight, per part by weight of the polyvinyl pyridine used.

(2) Quinones

Quinones are readily reduced to hydroquinones when exposed to actinic radiation in the presence of hydrogen-donors [e.g., hydrogen-containing polymers, for example, those polymers present in component (a)]. The resulting hydroquinone release, on heating, acids or hydrogen ions which can convert the polyvinyl pyridine to the quaternary salt thereof. Specific examples of suitable quinones which can be used include (i) unsubstituted quinone compounds such as 9,10-phenanthrenequinone, acenaphthene quinone, 9,10-anthraquinone, α-naphthoquinone, β-naphthoquinone, p-benzoquinone, etc.; and (ii) quinone compounds substituted with one or more substituents (which may be the same or different) such as an alkyl group (containing 1 to 7 carbon atoms); an alkyl group substituted with one or more of a halogen atom (e.g., a chlorine atom, a bromine atom, an iodine atom, etc.), a hydroxy group, an alkoxy group (containing 1 to 5 carbon atoms, e.g., a methoxy group, an ethoxy group, an n-butoxy group, etc.), a cyano group, an amino group and the like; a phenyl group; a phenyl group substituted with one or more of a halogen atom (e.g., a chlorine atom, a bromine atom, an iodine atom, etc.), a hydroxy group, an alkoxy group (containing 1 to 5 carbon atoms, e.g., a methoxy group, an ethoxy group, an n-butoxy group, etc.), an amino group, a mono- or di-alkylamino group (containing 1 to 5 carbon atoms in each alkyl moiety, e.g., a methylamino group, an ethylamino group, a dimethylamino group, a diethylamino group, etc.), a cyano group, a nitro group, an acyl group (e.g., an acetyl group) and the like; a hydroxy group; a halogen atom (e.g., a chlorine atom, a bromine atom, an iodine atom, etc.); an alkoxy group (containing 1 to 7 carbon atoms, e.g., a methoxy group, an ethoxy group, an n-butoxy group, etc.); a cyano group; a nitro group; an amino group; a mino- or di-alkylamino group (containing 1 to 5 carbon atoms in each alkyl moiety, e.g., a methylamino group, an ethylamino group, a dimethylamino group, a diethylamino group, etc.); an acyl group (e.g., an acetyl group); a carboxyl group; a carboxylic acid ester group (in which the ester moiety comprises an alkyl group having 1 to 7 carbon atoms, e.g., a methyl group, an ethyl group, an n-propyl group, an n-butyl group, an isobutyl group, an n-pentyl group, an n-hexyl group, etc.); and the like, with specific examples including 2-methyl-9,10-phenanthrenequinone, 3-chloroacenaphthenequinone, 2-bromoanthraquinone, 1-nitroanthraquinone, 1-chloro-2-aminoanthraquinone, 2-tert-butylanthraquinone, 3-methylnaphthoquinone, 3,6-dimethyl-2-naphthoquinone, 2,5-dimethyl-1,4-naphthoquinone, 4-benzyl-1,2-naphthoquinone, 3-chloro-1,2-naphthoquinone, duroquinone, trimethyl-p-benzoquinone, p-toluquinone, p-xyloquinone, chloranil, bromanil, tetracyano-p-benzoquinone, 2,3-dicyano-p-benzoquinone and the like. Where quinones are employed as component (b), halogen containing organic compounds (e.g., carbon tetrabromide, pentabromoethane, triphenylmethane bromide and those described in U.S. Pat. No. 3,042,515) or/and oxidizing agents (e.g., uranil nitrate, uranil oxalate, lead nitrate, sodium chloroaurate, triacetylacetonatocobalt(III), cobalt(II) nitrate, light sensitive cobalt complexes as hereinafter described, and so on) are preferably also employed in order to enhance the sensitivity. A suitable weight ratio of the quinone ranges preferably from about 0.05 to about 0.7 part by weight per part by weight of the polyvinyl pyridine used. And a suitable amount of the halogen-containing organic compound or the oxidizing agent preferably ranges from about 0.01 to about 0.8 part by weight per part by weight of the polyvinyl pyridine used.

(3) Light Sensitive Diazonium Salts

Light sensitive diazonium salts, for instance, substituted benzenediazonium salts, release phenolic compounds and hydrogen halides as the result of photolysis, and the phenolic compounds and hydrogen halides, in any cases, can convert the pyridyl groups of polyvinyl pyridines used to the form of quaternary salts directly or through heating and consequently, can inhibit the conversion of the polyvinylidene halide used to the corresponding polyene. These diazonium salts are described in detail in Jaromir Kosar, *Light-Sensitive Systems: Chemistry and Application of Non-silver Halide Photographic Processes.* Typical light-sensitive diazonium salts which are preferably employed in the present invention are illustrated below. In the description below X represents $Cl^-$, $Br^-$, $SO_4^-$, $NO_3^-$, $ClO_4^-$, $BF_4^-$ or a like anion. Further X may represent an ion which can be formed by addition of $ZnCl_2$, $CdCl_2$, $SnCl_4$ or a like salt to one of the above-described anions.

(i) Compounds having the following general formula (i)

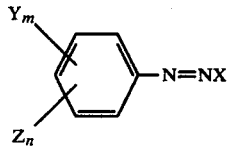

(i)

wherein Y and Z each represents an alkoxy group (containing 1 to 4 carbon atoms, e.g., a methoxy group, an ethoxy group, an n-propoxy group, an iso-propoxy group, an n-butoxy group, an iso-butoxy group, a tert-butoxy group, etc.), a halogen atom (e.g., a chlorine atom, a bromine atom, an iodine atom, etc.), an aryl group (e.g., a phenyl group, a naphthyl group, etc.) or the like; and m and n each represents zero or an integer of 1 to 5, and with specific examples including 4-ethoxybenzenediazonium chloride and 2,5-dimethoxybenzenediazonium chloride.

(ii) Compounds having the following general formula (ii)

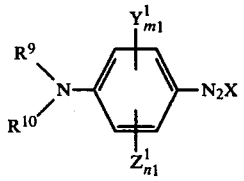

(ii)

wherein $R^9$ and $R^{10}$, which may be the same or different, each represents an alkyl group (containing 1 to 4 carbon atoms, e.g., a methyl group, an ethyl group, an n-propyl group, an iso-propyl group, an n-butyl group, an iso-butyl group, a tert-butyl group, etc.), an alkoxy group (containing 1 to 4 carbon atoms, e.g., a methoxy group, an ethoxy group, an n-propoxy group, an iso-propoxy group, an n-butoxy group, an iso-butoxy group, a tert-butoxy group, etc.), a hydroxyalkyl group (containing 1 to 4 carbon atoms, e.g., a hydroxyethyl group, etc.), a benzyl group which may be substituted with a methyl group, an ethyl group, a propyl group, a butyl group, a chlorine atom, a bromine atom, an iodine atom, etc., a phenyl group or a hydrogen atom; $Y^1$ and $Z^1$ each represents a halogen atom (e.g., a chlorine atom, a bromine atom, an iodine atom, etc.), an alkyl group (containing 1 to 4 carbon atoms, e.g., a methyl group, an ethyl group, an n-propyl group, an iso-propyl group, an n-butyl group, an iso-butyl group, a tert-butyl group, etc.), a carboxy group, an alkoxy group (containing 1 to 4 carbon atoms, e.g., a methoxy group, an ethoxy group, an n-propoxy group, an iso-propoxy group, an n-butoxy group, an iso-butoxy group, a tert-butoxy group, etc.), a nitro group or an acyl group (containing 2 to 5 carbon atoms, e.g., an acetyl group, etc.); and $m_1$ and $n_1$ each represents zero or a positive integer of 4 or less, with specific examples including 4-(N,N-dimethylamino)benzenediazonium chloride, 3-chloro-4-(N,N-dimethylamino)benzenediazonium chloride, 4-(N,N-diethylamino)benzenediazonium chloride, 1,6-diethoxy-4-(N,N-diethylamino)benzenediazonium chloride, 4-(N-ethyl-N-hydroxyethylamino)benzenediazonium chloride, 4-(N,N-diethoxyamino)benzenediazonium chloride, 4-(phenylamino)benzenediazonium chloride, 4-[N-(p-methoxyphenyl-)amino]benzenediazonium chloride and the like.

(iii) Compounds having the following general formula (iii):

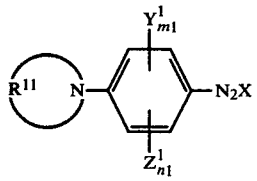

(iii)

wherein $R^{11}$ represents $—CH_2CH_2OCH_2CH_2—$, $—CH_2OCH_2CH_2—$ or the like; and $Y^1$, $Z^1$, $m_1$ and $n_1$ each has the same meaning as in the general formula (ii), with specific examples including 4-morpholinobenzenediazonium chloride, 2,5-diethoxy-4-morpholinobenzenediazonium chloride, 4-oxazolidinobenzenediazonium chloride and the like.

(iv) Compounds having the following general formula (iv):

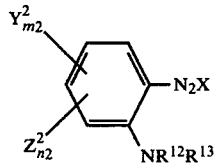

(iv)

wherein $R^{12}$ and $R^{13}$ which may be the same or different, each represents a hydrogen atom, an alkyl group (containing 1 to 4 carbon atoms, e.g., a methyl group, an ethyl group, an n-propyl group, an iso-propyl group, an n-butyl group, an iso-butyl group, a tert-butyl group, etc.) or the like; $Y^2$ and $Z^2$, which may be the same or different, each represents an alkyl group (containing 1 to 4 carbon atoms, e.g., a methyl group, an ethyl group, an n-propyl group, an iso-propyl group, an n-butyl group, an iso-butyl group, a tert-butyl group, etc.), an alkoxy group (containing 1 to 4 carbon atoms, e.g., a methoxy group, an ethoxy group, an n-propoxy group, an iso-propoxy group, an n-butoxy group, an iso-butoxy group, a tert-butoxy group, etc.), a carboxy group, an acyl group (containing 2 to 5 carbon atoms, e.g., an acetyl group), an aryl group (e.g., a phenyl group, a naphthyl group, etc.) or the like; and $m_2$ and $n_2$ each represents zero or a positive integer of 4 or less, with specific examples including 4,5-dimethyl-2-(dimethylamino)-benzenediazonium chloride and so on.

(v) Compounds having the following general formula (v)

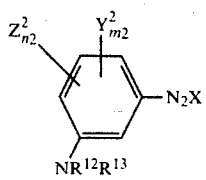

(v)

wherein $R^{12}$, $R^{13}$, $Y^2$, $Z^2$, $m_2$ and $n_2$ each has the same meaning as in the general formula (iv), with specific examples including 3-(dimethylamino)benzenediazonium chloride and so on.

(vi) Compounds having the following general formula (vi)

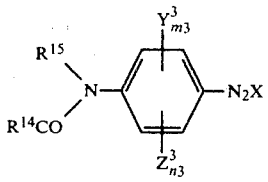

(vi)

wherein $R^{14}$ represents an alkyl group (containing 1 to 4 carbon atoms, e.g., a methyl group, an ethyl group, an n-propyl group, an iso-propyl group, an n-butyl group, an iso-butyl group, a tert-butyl group, etc.), an alkoxy group (containing 1 to 4 carbon atoms, e.g., a methoxy group, an ethoxy group, an n-propoxy group, an iso-propoxy group, an n-butoxy group, an iso-butoxy group, a tert-butoxy group, etc.), an aryl group (e.g., a phenyl group, a naphthyl group, etc.) or the like; $R^{15}$ represents a hydrogen atom or an alkyl group (containing 1 to 4 carbon atoms, e.g., a methyl group, an ethyl group, an n-propyl group, an iso-propyl group, an n-butyl group, an iso-butyl group, a tert-butyl group, etc.); $Y^3$ and $Z^3$, which may be the same or different, each represents a halogen atom (e.g., a chlorine atom, a bromine atom, an iodine atom, etc.), an alkyl group (containing 1 to 4 carbon atoms, e.g., a methyl group, an ethyl group, an n-propyl group, an isopropyl group, an n-butyl group, an iso-butyl group, a tert-butyl group, etc.), an alkoxy group (containing 1 to 4 carbon atoms, e.g., a methoxy group, an ethoxy group, an n-propoxy group, an iso-propoxy group, an n-butoxy group, an iso-butoxy group, a tert-butoxy group, etc.) or the like; and $m_3$ and $n_3$ each represents zero or a positive integer of 4 or less, with specific examples including 2,5-di(ethoxybenzoylamino)benzenediazonium chloride, 2,5-di(butoxybenzoylamino)benzenediazonium chloride and the like.

(vii) Compounds having the following general formula (vii)

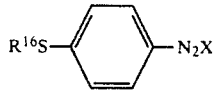

(vii)

wherein $R^{16}$ represents an alkyl group (containing 1 to 4 carbon atoms) or an aryl group (e.g., a phenyl group, a naphthyl group, etc.), with specific examples including 4-ethylthio-2,5-diethoxybenzenediazonium chloride, 4-tolylthio-2,5-diethoxybenzenediazonium chloride, 4-benzylthio-2,5-dimethoxybenzenediaznoium chloride and the like.

A suitable amount of such a light-sensitive diazonium salt preferably ranges from about 0.1 to about 1.5 parts by weight per part by weight of the polyvinyl pyridine used.

Iodoform is the most preferred light sensitive compound of the above-described compounds suitable for the light sensitizing element (b) of this invention.

Although the image recording material of the present invention basically comprises the heat sensitive coloring element comprising the mixture of the polyvinyl pyridine and the polyvinylidene halide as described hereinbefore, and the light sensitizing element controlling the coloration reaction in an imagewise manner, the image recording material of this invention can also contain metallic oxide powders. The presence additionally of metallic oxide powders causes the color tone of the image formed to be a blacker tone and as a result, the density of fog is decreased in light exposed areas. Specific examples of suitable metallic oxide powders which can be used include $TiO_2$, ZnO, PbO, $SnO_2$, $ZrO_2$, $GeO_2$, $TeO_2$, MgO, $SiO_2$, $Al_2O_3$, $Sb_2O_3$, $MoO_3$, $GeO_2$, $WO_3$, $Bi_2O_3$ and so on. A suitable amount of these metal oxide powders preferably ranges from about 0.5 to about 3 parts by weight per part by weight of the total weight of the polyvinyl pyridine and the polyvinylidene halide.

The light-sensitive image recording material of the present invention can be prepared by dissolving or/and dispersing the polyvinyl pyridine and the polyvinylidene halide as component (a), the compound described above as the light sensitizing element compound (b) and optionally, the metallic oxide powder, into an appropriate solvent, followed by coating the resulting solution or dispersion onto a support and then, drying the coating. Suitable solvents which can be used are solvents which can dissolve at least the polyvinyl pyridine and the polyvinylidene halide. Specific examples of suitable solvents include N,N-dimethylformamide, N-methylformamide, formamide, N,N-dimethylacetamide, dimethyl sulfoxide, tetrahydrofuran, 1,4-dioxane, acetone, methyl ethyl ketone, methyl isobutyl ketone, cyclohexane, tetrachloroethane, ethylene chloride, methylene chloride, chloroform, chlorobenzene, ethyl acetate, methanol, ethanol, isopropanol, butanol, ethylene glycol monomethyl ether and so on. These solvents can be employed individually or as combinations in appropriate mixing ratios. A preferred weight ratio of the total weight of polymers present in the coating solution to the weight of the solvent used therein ranges from about 1:5 to about 1:50.

Also, the light-sensitive image recording material of the present invention can be prepared by coating component (a) and component (b) separately on a support so that the resulting layers are adjacent each other and then, drying the layers. Where this approach is used, component (b) [particularly, when quinones are employed as component (b)] is preferably used in a form of a dispersion prepared by dispersing component (b) into an appropriate binder. Suitable binders which can be used are binders which are stable to moisture, which can be stored for a long time, which are sufficiently inert to heat employed upon development and further, which possess high solubilities in certain solvents and satisfactory film-forming abilities. To meet the above-described requirements, the molecular weight of the high polymers used as the binder should range, in general, from about 10,000 to about 500,000. Examples of suitable high polymers include various kinds of vinyl polymers such as polyvinyl chloride, polyvinyl acetate, polyvinyl alcohol, polyvinyl formal, polyvinyl butyral, polystyrene, poly(methyl methacrylate), polyvinyl pyrrolidone and the like; condensation polymerization type synthetic high polymers such as polyamides (e.g., nylon), polyesters or the like; semi-synthetic high polymers such as cellulose acetates; natural high polymers such as gelatin; and so on.

A wide variety of materials can be used as the support in the shape of a sheet, a film or a plate. Specific examples of suitable support materials include polyethylene terephthalate films, polyimide films, polyamide (e.g., nylon) films, polycarbonate films, cellulose triacetate films, papers, synthetic papers, cloth, leather, synthetic leather, wood plates, glass plates, metal plates and so on.

The coating can be carried out using various techniques well known to one skilled in the art. For instance, coating can be accomplished using rod coating, roller coating, curtain coating, dip coating, spinner coating and so on.

Moreoever, since component (a) itself can be a self-supporting film, the composition containing component (a) and component (b) may be subjected to a shaping treatment using extrusion or casting to form a film. Such a self-supporting film has a dry thickness ranging preferably from about 10 to about 200 microns.

In all cases, the drying treatment is preferably carried out at a temperature ranging from about 20° C. to about 80° C. over a period of about 0.5 to about 3 hours by exposing the coated layer(s) or the film in flowing air. The image recording layer is provided on a support at a dry coverage ranging preferably from about 1 to about 50 μm, particularly preferably from 3 to 30 μm.

Recording of an image using the light-sensitive image recording material of the present invention is illustrated below. The light-sensitive image recording material upon which an original is closely superposed is, in general, exposed to light through the original. The term "light" is used herein in its broad sense to include electromagnetic radiation which is actinic in nature to the light sensitizing element (b) (e.g., radiation ranging in wavelength from the UV region through the visible region) and suitable light sources which can be used include a mercury lamp, a xenon lamp, a carbon arc lamp, a tungsten lamp, a laser and the like. The time required for the exposure is, for instance, on the order of 10 to 100 seconds when the exposure is carried out using, as a light source, a 1 Kw xenon lamp positioned at distance of 30 centimeters from the recording material.

By uniformly heating the optically exposed recording material, the resulting latent image is developed and converted to a blackish-brown image consisting of polyenes and, consequently, to be recorded as a permanent image. The heat development can be performed using various methods, for example, by closely contacting the optically exposed recording material with a uniformly heated hot plate, by passing the optically exposed image recording material through a pair of heated rollers, or by immersing the optically exposed image recording material in a heated liquid such as a heated silicone oil. A suitable heating temperature ranges preferably from about 100° C. to about 200° C., more preferably from 140° C. to 180° C., and a suitable heating time ranges from about 5 seconds to about 200 seconds, preferably from 20 seconds to 100 seconds.

In accordance with the present invention, it has been found that light-sensitive image recording materials and dry recording processes using the light-sensitive image recording materials of this invention possess excellent characteristics, some of which are described hereinafter, and, therefore, will be very useful.

Some of the excellent characteristics include the following characteristics:

(1) Images can be recorded using a dry recording process, without any liquids being required.

(2) The light-sensitive image recording materials obtained are homogeneous and transparent.

(3) The images produced are blackish-brown, have a very high image density and are positive-positive type images.

(4) The images produced are made of polyenes and consequently, are quite stable to light, heat, oxygen and so on. Therefore, they are not discolored by exposure to light or on storage for a long time.

(5) The light-sensitive image recording materials of the present invention have a higher optical sensitivity than that of conventional light-sensitive image recording materials utilizing halogen-containing high polymers. (For instance, although the light-sensitive image recording materials containing halogenated high polymers and metallic oxides, which are disclosed in U.S. Pat. No. 2,772,159, require an exposure of $1.2\times10^8$ erg/cm for producing images, the light-sensitive image recording materials of the present invention can be used to produce images with satisfactorily high density using an optical exposure of $10^6$ to $10^7$ erg/cm.)

The present invention will now be illustrated in greater detail by reference to the following examples. However, the invention is not intended to be construed as being limited to these examples.

EXAMPLE 1

0.5 g of poly-4-vinylpyridine (having an average molecular weight of about 100,000) synthesized using a radical polymerization process, e.g., as described in Synthesis Example 1 above, 0.3 g of Saran F-220 (trade name, produced by Asahi-Dow, Ltd.; vinylidene chloride-acrylonitrile copolymer with a monomer mole ratio of 4:1 and an average molecular weight of about 100,000), e.g., synthesized as described in Synthesis Example 4 above, and 1.0 g of iodoform were dissolved in 5 g of N,N-dimethylformamide at room temperature (about 20°–30° C.). The resulting solution was coated on a support of a polyethylene terephthalate film of a thickness of 100 μm using a coating rod, and dried at 30° C. for 2 hours using an air current. The thickness of the image recording layer provided on the support was about 10 μm in a completely dried state. Then, an original with a positive image was closely superposed upon the image recording layer, and the assembly was exposed to light through the original using as a light source a xenon lamp of 1 Kw positioned at a distance of 30 centimeters therefrom for 60 seconds. Thus, the optically exposed areas (corresponding to the non-image areas of the original) were colored yellow. Next, the optically exposed image recording material was closely contacted with a hot plate heated uniformly at 150° C. for 60 seconds to result in the formation of a blackish-brown coloration at the unexposed areas, that is to say, to result in the production of a clear positive image. (However, an orange colored fog occurred in the non-image areas.)

EXAMPLES 2 TO 5

The procedures as described in Example 1 were repeated except that the polyvinyl pyridine polymers set forth below were employed instead of the poly-4-vinylpyridine used in Example 1. In all cases, blackish-brown images were obtained on exposure and development.

| Example No. | Polovinyl Pyridine Polymer* |
|---|---|
| 2 | 4-Vinylpyridine - Styrene Copolymer (monomer ratio : about 1:1) |
| 3 | Poly-3-vinylpyridine |
| 4 | Poly-2-methyl-5-vinylpyridine |
| 5 | 3-Vinylpyridine - Acrylonitrile Copolymer (monomer ratio : about 1:1) |

*All of the polymers were produced by radical polymerization,and had an average molecular weight of about 100,000.

EXAMPLES 6 TO 8

The procedures described in Example 1 were repeated except that the polyvinylidene polymers set forth below (each of which was synthesized by radical polymerization and had an average molecular weight of about 100,000) were employed instead of the Saran F-220 employed in Example 1. In all cases, blackish-brown positive images were obtained on exposure and development.

| Example No. | Polyvinylidene Halide Polymer |
|---|---|
| 6 | Vinylidene Chloride - Acrylonitrile Copolymer (monomer ratio : about 1:1) |
| 7 | Vinylidene Chloride - Styrene Copolymer (monomer ratio : about 4:1) |
| 8 | Vinylidene Bromide - Methyl Methacrylate Copolymer (monomer ratio : about 2:1) |

EXAMPLE 9

The procedures as described in Example 1 were repeated except that a coating solution for the image recording layer was prepared by adding additionally 0.7 g of rutile type titanium dioxide powder to the coating solution as described in Example 1 and dispersing the titanium dioxide powder well in the coating solution. A black positive image was obtained on exposure and development. The fog occurring in the non-image areas was light yellow and lighter in color than that produced in Example 1. Accordingly, the image contrast was improved in this example.

EXAMPLE 10

0.5 g of poly-4-vinylpyridine as described in Example 1, and 0.3 g of Saran F-220 were dissolved in 5 g of N,N-dimethylformamide. The resulting solution was coated on a polyethylene terephthalate film of a thickness of 100 μm using a coating rod, and dried at 30° C. for 2 hours using an air current. On the resulting coated layer, a solution of 0.04 g of 9,10-phenanthrenequinone, 0.2 g of polyvinyl butyral (Denka Butyral ½4000-2, trade name, produced by Electro Chemical Industry Co., Ltd., having an average degree of polymerization of 1,000), 0.2 g of Saran F-220 and 4 g of N,N-dimethylformamide was coated using a coating rod, and dried at 30° C. for 2 hours using an air current. The total dry thickness of the image recording layers on the support was about 15 microns. The resulting material was exposed to light from a xenon lamp through a positive original for 60 seconds and heated at 150° C. for 60 seconds in a similar manner to Example 1 to produce a blackish-brown colored positive image. A brown-colored fog occurred in the non-image areas (exposed areas).

EXAMPLES 11 TO 13

The procedures as described in Example 10 were repeated except that one of the compounds set forth below was further added to the 9,10-phenanthrenequinone-containing coating solution in an amount of 0.1 g. Blackish-brown positive images were obtained on exposure and development. The fog occurring in the non-image areas was lighter than that in Example 10. Therefore, the image contrast was improved.

| Example No. | Compound Added |
|---|---|
| 11 | Carbon Tetrabromide |
| 12 | Pentabromoethane |
| 13 | Uranil Nitrate |

EXAMPLE 14

The procedures as described in Example 11 were repeated except that 1 g of rutile type titanium dioxide was further added to and, then, dispersed into the coating solution of the poly-4-vinylpyridine, Saran F-220 and N,N-dimethylformamide. A black positive image was obtained on exposure and development and an improvement in image contrast larger than that obtained in Example 11 was obtained.

EXAMPLES 15 TO 18

0.5 g of poly-4-vinylpyridine, as described in Example 1, and 0.3 g of Saran F-220 were dissolved in 5 g of N,N-dimethylformamide. Then, one of compounds set forth in the following table in the amount described was added to and dissolved in the resulting solution. 0.1 g of 9,10-phenanthrenequinone was ultimately dissolved in the resulting solution. The thus-obtained solution was coated on a polyethylene terephthalate film of a thickness of 100 μm using a coating rod, and dried at 30° C. for 2 hours using an air current to prepare an image recording material. The thickness of the image recording layer provided on the support was about 10 μm. This material was, in a similar manner to that described in Example 1, was exposed to light generated from a xenon lamp through a positive original for 60 seconds and then, heated at a temperature of 150° C. for 40 seconds to result in the formation of blackish-brown positive images. A light brown fog was observed in the non-image areas (exposed areas).

| Example No. | Compound Added | Amount Used (g) |
|---|---|---|
| 15 | Uranil Nitrate | 0.15 |
| 16 | Sodium Chloroaurate | 0.04 |
| 17 | Sodium Chloroaurate + Uranil Nitrate | 0.02 + 0.12 |
| 18 | Lead Nitrate | 0.08 |

EXAMPLES 19 TO 21

0.6 g of poly-4-vinylpyridine as described in Example 1 and 0.3 g of Saran F-220 were dissolved in 5 g of N,N-dimethylformamide and then one of the light sensitive diazonium salts described in the table below in an amount of 0.3 g was dissolved in the solution. The resulting coating solution was coated, dried, exposed to light and then, heated in the same manner as described in Example 1 to produce brown positive images. (An orange fog was observed at the non-image areas.)

| Ex. No. | Light Sensitive Diazonium Salt |
|---|---|
| 19 | 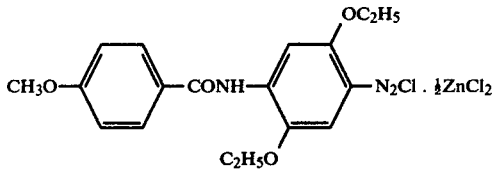 |
| 20 | 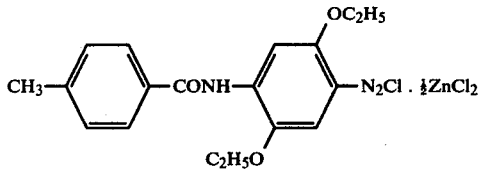 |
| 21 | 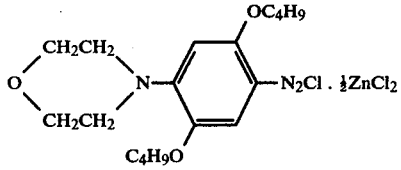 |

While the invention has been described in detail and with reference to specific embodiments thereof, it will be apparent to one skilled in the art that various changes and modifications can be made therein without departing from the spirit and scope thereof.

What is claimed is:

1. A light-sensitive image recording material comprising, as a self-supporting film or in one or more layers on a support, at least
   (a) a heat sensitive coloring element comprising at least one polyvinyl pyridine and at least one polyvinylidene halide, and
   (b) a light sensitizing element comprising at least one of
      (1) a compound which, on exposure to actinic radiation, is capable of complexing the polyvinyl pyridine of element (a) or is capable of forming a quaternary salt with the polyvinyl pyridine of element (a), or
      (2) a compound which, on exposure to actinic radiation, is capable of releasing a precursor which is capable of complexing the polyvinyl pyridine of element (a) or is capable of forming a quaternary salt with the polyvinyl pyridine of element (a) under heating, wherein said compound (b)(1) or (b)(2) is iodoform, a quinone or a light-sensitive diazonium salt.

2. The light-sensitive image recording material of claim 1, wherein said polyvinyl pyridine of element (a) is (i) a homopolymer containing as a repeating unit a repeating unit of at least one addition polymerizable monomer selected from the group consisting of compounds represented by the general formulae (I) and (II)

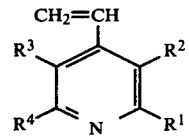

(I)

or

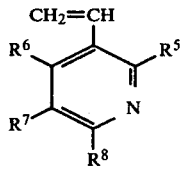

(II)

wherein $R^1$, $R^2$, $R^3$, $R^4$, $R^5$, $R^6$, $R^7$ and $R^8$, which may be the same or different, each represents a hydrogen atom or a straight or branched chain alkyl group having 1 to 7 carbon atoms or (ii) a copolymer of at least one addition polymerizable monomer selected from the group consisting of compounds represented by the general formulae (I) and (II) above with at least one other addition polymerizable monomer copolymerizable therewith, with the addition polymerizable monomer selected from the group consisting of compounds represented by the general formulae (I) and (II) being present in the copolymer in a mol fraction of at least about 0.3.

3. The light-sensitive image recording material of claim 2, wherein said addition polymerizable monomer represented by the general formulae (I) and (II) is 4-vinyl pyridine, 3-vinyl pyridine, 2-methyl-4-vinyl pyridine, 2-ethyl-5-vinyl pyridine, 3-methyl-5-vinyl pyridine, 3-n-butyl-5-vinylidene, 2-ethyl-4-vinylpyridine, 3-methyl-4-vinylpyridine, 3-isopropyl-4-vinylpyridine or 2-methyl-5-vinylpyridine.

4. The light-sensitive image recording material of claim 1, wherein said polyvinylidene halide of element (a) is (i) a homopolymer containing as a repeating unit the repeating unit of at least one monomer selected from the group consisting of vinylidene chloride and vinylidene bromide or (ii) a copolymer of at least one monomer selected from the group consisting of vinylidene chloride and vinylidene bromide and at least one other addition polymerizable monomer copolymerizable therewith, with the vinylidene chloride and/or vinylidene bromide monomer being present in the copolymer in a mol fraction of at least about 0.3.

5. The light-sensitive image recording material of claim 1, wherein the polyvinyl pyridine and the polyvinylidene halide are present in the heat sensitive coloring element (a) in a weight ratio of from about 8:1 to about 1:5.

6. The light-sensitive image recording material of claim 1, wherein said compound (1) or said compound (2) of said light sensitizing element (b) is iodoform.

7. The light-sensitive image recording material of claim 6, wherein the iodoform is present in said light sensitizing element (b) in an amount of about 1.5 to about 3 parts by weight per part by weight of the polyvinyl pyridine of element (a).

8. The light-sensitive image recording material of claim 1, wherein said compound (1) or said compound (2) of said light sensitizing element (b) is a quinone.

9. The light-sensitive image recording material of claim 8, wherein said light sensitizing element (b) additionally contains at least one of a halogen-containing organic compound and an oxidizing agent.

10. The light-sensitive image recording material of claim 8 or 9, wherein said quinone is an unsubstituted quinone or a quinone substituted with one or more of an alkyl group; an alkyl group substituted with one or more of a halogen atom, a hydroxy group, an alkoxy group, a cyano group, or an amino group; a phenyl group; a phenyl group substituted with one or more of a halogen atom, a hydroxy group, an alkoxy group, an amino group, a monoalkylamino group, a dialkylamino group, a cyano group, a nitro group, or an acyl group; a hydroxyl group; a halogen atom; an alkoxy group; a cyano group; a nitro group; an amino group; a monoalkylamino group; a dialkylamino group; an acyl group; a carboxy group; or a carboxylic acid ester group.

11. The light-sensitive image recording material of claim 9 or 10, wherein said quinone is present in said light sensitizing element (b) in an amount of about 0.05 to about 0.7 part by weight per part by weight of the polyvinyl pyridine of element (a).

12. The light-sensitive image recording material of claim 1, wherein said compound (1) or said compound (2) of said light sensitizing element (b) is a light-sensitive diazonium salt.

13. The light-sensitive image recording material of claim 12, wherein said light-sensitive diazonium salt is present in said light sensitizing element (b) in an amount of about 0.1 to about 1.5 parts by weight per part by weight of the polyvinyl pyridine in element (a).

14. A dry process for recording an image which comprises (1) imagewise exposing to actinic radiation the light-sensitive image recording material of claim 1, and (2) uniformly heating the imagewise exposed recording material to a temperature of about 100° C. to about 200° C.

15. The process of claim 14, wherein the imagewise exposure is equivalent to about 10 to 100 seconds using, as a light source, a 1 KW xenon lamp at a distance of 30 centimeters from the recording material.

16. The process of claim 15, wherein the heating is at a temperature of 140° C. to 180° C.

17. The light-sensitive image recording material of claim 1, wherein element (b) is element (b) (1).

18. The light-sensitive image recording material of claim 1, wherein element (b) is element (b) (2).

19. The light-sensitive image recording material of claim 1, wherein said polyvinyl pyridine of element (a) is (i) a homopolymer containing as a repeating unit a repeating unit of at least one addition polymerizable monomer selected from the group consisting of compounds represented by the general formula (I) and (II)

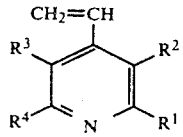

(I)

or

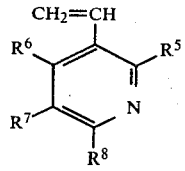

(II)

wherein $R^1$, $R^2$, $R^3$, $R^4$, $R^5$, $R^6$, $R^7$ and $R^8$, which may be the same or different, each represents a hydrogen atom or a straight or branched chain alkyl group having 1 to 7 carbon atoms or (i) a copolymer of at least one addition polymerizable monomer selected from the group consisting of compounds represented by the general formulae (I) and (II) above with at least one other addition polymerizable monomer copolymerizable therewith, with the addition polymerizable monomer selected from the group consisting of compounds represented by the general formulae (I) and (II) being present in the copolymer in a mol fraction of at least about 0.3 and wherein said polyvinylidene halide of element (a) is (i) a homopolymer containing as a repeating unit the repeating unit of at least one monomer selected from the group consisting of vinylidene chloride and vinylidene bromide or (ii) a copolymer of at least one monomer selected from the group consisting of vinylidene chloride and vinylidene bromide and at least one other addition polymerizable monomer copolymerizable therewith, with the vinylidene chloride and/or vinylidene bromide monomer being present in the copolymer in a mol fraction of at least about 0.3.

20. The light-sensitive image recording material of claim 1, wherein element (b) is selected from the group consisting of iodoform, unsubstituted quinone compounds, quinone compounds substituted with one or more substituents which may be the same or different selected from the group consisting of an alkyl group, an alkyl group substituted with one or more of a halogen atom, a hydroxy group, an alkoxy group, a cyano group and an amino group; a phenyl group; a phenyl group substituted with one or more of a halogen atom, a hydroxy group, an alkoxy group, an amino group, a mono- or di-alkylamino group, a cyano group, a nitro group and an acyl group; a hydroxy group; an halogen atom; an alkoxy group; a cyano group; a nitro group; an amino group; a mono- or di-alkylamino group; an acyl group, and a carboxylic acid ester group; compounds having the general formula (i):

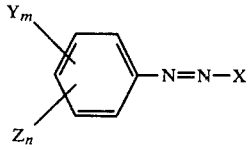

(i)

wherein Y and Z each represents an alkoxy group, a halogen atom, or an aryl group, and X represents $Cl^-$, $Br^-$, $SO_4^-$, $ClO_4^-$, $BF_4^-$ or an ion which can be formed by addition of $ZnCl_2$, $CdCl_2$ or $SnCl_4$ to one of the above described anions, and m and n each represents 0 or an integer of 1 to 5; compounds having the general formula (ii):

(ii)

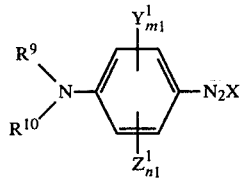

wherein $R^9$ and $R^{10}$, which may be the same or different, each represents an alkyl group, an alkoxy group, a hydroxy alkyl group, a benzyl group, a benzyl group substituted with an alkyl group or a halogen atom, a phenyl group or a hydrogen atom; $Y^1$ and $Z^1$ each represents a halogen atom, an alkyl group, a carboxy group, an alkoxy group, a nitro group or an acyl group, and $m_1$ and $n_1$ each represents 0 or a positive integer of 4 or less; compounds having the general formula (iii):

(iii)

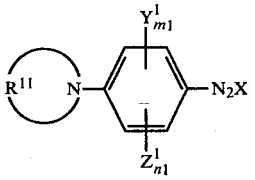

wherein $R^{11}$ represents $—CH_2CH_2OCH_2CH_2—$, or $—CH_2OCH_2CH_2—$ and $Y^1$, $Z^1$, $m_1$ and $n_1$ each has the same meaning as in general formula (ii); compounds having the general formula (iv):

(iv)

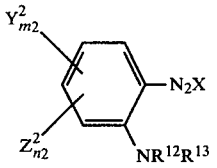

wherein $R^{12}$ and $R^{13}$, which may be the same or different, each represents a hydrogen atom or an alkyl group, $Y_2$ and $Z_2$, which may be the same or different, each represents an alkyl group, an alkoxy group, a carboxy group, an acyl group or an aryl group; $m_2$ and $n_2$ each represents 0 or a positive integer of 4 or less; compounds having the general formula (v):

(v)

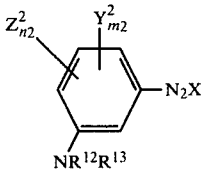

wherein all moieties have the same meaning as in general formula (iv); compounds having the general formula (vi):

(vi)

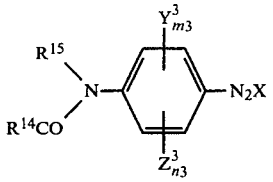

wherein $R^{14}$ represents an alkyl group, an alkoxy group, or an aryl group; $R^{15}$ represents a hydrogen atom or an alkyl group; $Y^3$ and $Z^3$, which may be the same or different, each represents a halogen atom, an alkyl group, or an alkoxy group, and $m_3$ and $n_3$ each represents 0 or a positive integer of 4 or less; and compounds having the general formula (vii):

(vii)

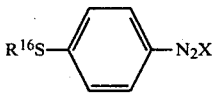

21. The process of claim 15, wherein element (b) is element (b) (1).

22. The process of claim 15, wherein element (b) is element (b) (2).

23. The process of claim 15, wherein element (b) complexes or forms a quaternary salt with the polyvinyl pyridine of element (a) in exposed areas, whereby in unexposed areas the polyvinyl pyridine of element (a) remains to accelerate the dehydrohalogenation of the polyvinylidene halide to yield a polyene image.

24. The process of claim 15, wherein said polyvinyl pyridine of element (a) is (i) a homopolymer containing as a repeating unit a repeating unit of at least one addition polymerizable monomer selected from the group consisting of compounds represented by the general formula (I) and (II)

(I)

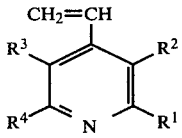

or

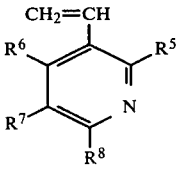

wherein $R^1$, $R^2$, $R^3$, $R^4$, $R^5$, $R^6$, $R^7$ and $R^8$, which may be the same or different, each represents a hydrogen atom or a straight or branched chain alkyl group having 1 to 7 carbon atoms or (i) a copolymer of at least one addition polymerizable monomer selected from the group consisting of compounds represented by the general formulae (I) and (II) above with at least one other addition polymerizable monomer copolymerizable therewith, with the addition polymerizable monomer selected from the group consisting of compounds represented by the general formulae (I) and (II) being present in the copolymer in a mol fraction of at least about 0.3 and wherein said polyvinylidene halide of element (a) is (i) a hompolymer containing as a repeating unit the repeating unit of at least one monomer selected from the group consisting of vinylidene chloride and vinylidene bromide or (ii) a copolymer of at least one monomer selected from the group consisting of vinylidene chloride and vinylidene bromide and at least one other addition polymerizable monomer copolymerizable therewith, with the vinylidene chloride and/or vinylidene bromide monomer being present in the copolymer in a mol fraction of at least about 0.3.

25. The process of claim 22, wherein element (b) is selected from the group consisting of iodoform, unsubstituted quinone compounds, quinone compounds substituted with one or more substituents which may be the same or different selected from the group consisting of an alkyl group, an alkyl group substituted with one or more of a halogen atom, a hydroxy group, an alkoxy group, a cyano group and an amino group; a phenyl group; a phenyl group substituted with one or more of a halogen atom, a hydroxy group, an alkoxy group, an amino group, a mono- or di-alkylamino group, a cyano group, a nitro group and an acyl group; a hydroxy group; an halogen atom; an alkoxy group; a cyano group; a nitro group; an amino group; a mono- or di-alkylamino group; an acyl group, and a carboxylic acid ester group; compounds having the general formula (i):

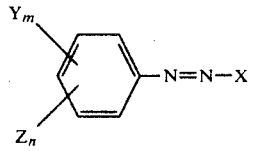

(i)

wherein Y and Z each represents an alkoxy group, a halogen atom, or an aryl group, and X represents $Cl^-$, $Br^-$, $SO_4^-$, $ClO_4^-$, $BF_4^-$ or an ion which can be formed by addition of $ZnCl_2$, $CdCl_2$ or $SnCl_4$ to one of the above described anions, and m and n each represents 0 or an integer of 1 to 5; compounds having the general formula (ii):

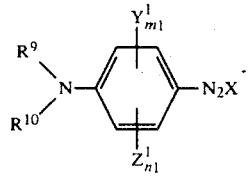

(ii)

wherein $R^9$ and $R^{10}$, which may be the same or different, each represents an alkyl group, an alkoxy group, a hydroxy alkyl group, a benzyl group, a benzyl group substituted with an alkyl group or a halogen atom, a phenyl group or a hydrogen atom; $Y^1$ and $Z^1$ each represents a halogen atom, an alkyl group, a carboxy group, an alkoxy group, a nitro group or an acyl group, and $m_1$ and $n_1$ each represents 0 or a positive integer of 4 or less; compounds having the general formula (iii):

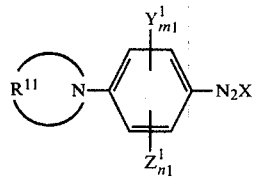

(iii)

wherein $R^{11}$ represents $—CH_2CH_2OCH_2CH_2—$, or $—CH_2OCH_2CH_2—$ and $Y^1$, $Z^1$, $m_1$ and $n_1$ each has the same meaning as in general formula (ii); compounds having the general formula (iv):

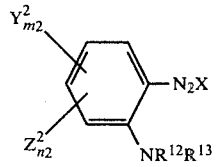

(iv)

wherein $R^{12}$ and $R^{13}$, which may be the same or different, each represents a hydrogen atom or an alkyl group, $Y_2$ and $Z_2$, which may be the same or different, each represents an alkyl group, an alkoxy group, a carboxy group, an acyl group or an aryl group; $m_2$ and $n_2$ each represents 0 or a positive integer of 4 or less; compounds having the general formula (v):

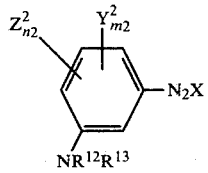

(v)

wherein all moieties have the same meaning as in general formula (iv); compounds having the general formula (vi):

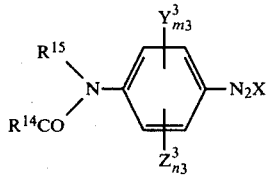

(vi)

wherein $R^{14}$ represents an alkyl group, an alkoxy group, or an aryl group; $R^{15}$ represents a hydrogen atom or an alkyl group; $Y^3$ and $Z^3$, which may be the same or different, each represents a halogen atom, an alkyl group, or an alkoxy group, and $m_3$ and $n_3$ each represents 0 or a positive integer of 4 or less; and compounds having the general formula (vii):

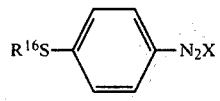

(vii)

wherein $R^{16}$ represents an aryl group or an alkyl group.

* * * * *